United States Patent [19]

Arzumanov et al.

[11] 4,044,988

[45] Aug. 30, 1977

[54] BLOWOUT RAM PREVENTER

[76] Inventors: Suren Akopovich Arzumanov, ulitsa Bogdana Khmelnitskogo, 2/15, kv.44, Moscow; Armais Avakovich Danieliants, ulitsa Nizami, 66, kv. 52, Baku; Kerim Salim ogly Aliverdizade, ulitsa Nizami, 66, kv. 19, Baku; Gasan Neimat ogly Seidov, ulitsa Chapaeva, 102, kv. 57, Baku; Artur Tair ogly Rasi-Zade, Tbilissky prospekt, 1 mikroraion, A-2, kv. 63, Baku; Boris Ovseevich Frenkel, ulitsa Chapaeva, 66, kv. 10, Baku; Jury Alexandrovich Samoilov, ulitsa Nakhichevanskogo, 18, kv. 85, Baku, all of U.S.S.R.

[21] Appl. No.: 595,218

[22] Filed: July 11, 1975

[51] Int. Cl.[2] ..... E21B 33/06

[52] U.S. Cl. ..... 251/1 A; 277/129

[58] Field of Search ..... 251/1 R, 1 A, 191; 277/126, 127, 129; 166/82, 84, 86

[56] References Cited

U.S. PATENT DOCUMENTS

| | | | |
|---|---|---|---|
| 1,586,923 | 6/1926 | Townsend | 251/1 A X |
| 1,695,992 | 12/1928 | Bergsten | 251/1 A X |
| 2,193,110 | 3/1940 | Penick et al. | 277/129 |
| 2,255,829 | 9/1941 | Spang et al. | 166/86 |
| 2,746,710 | 5/1956 | Jones | 251/1 A |
| 3,737,139 | 6/1973 | Watts | 251/1 B |

*Primary Examiner*—Martin P. Schwadron
*Assistant Examiner*—Richard Gerard

[57] ABSTRACT

A blow out ram preventer comprising a housing with a longitudinal cavity and a transverse through bore. Rams are arranged in the cavity of the housing to reciprocate therein relative to the bore. The transverse spacing between longitudinal guides at the walls of the cavity is uniformly reduced in the direction from the ends of the housing to the bore, the ram packer being reinforced from the bore side with radial metal members while the body of the ram is comprised of a plurality of members adapted to move relative to one another during movement of the ram.

4 Claims, 10 Drawing Figures

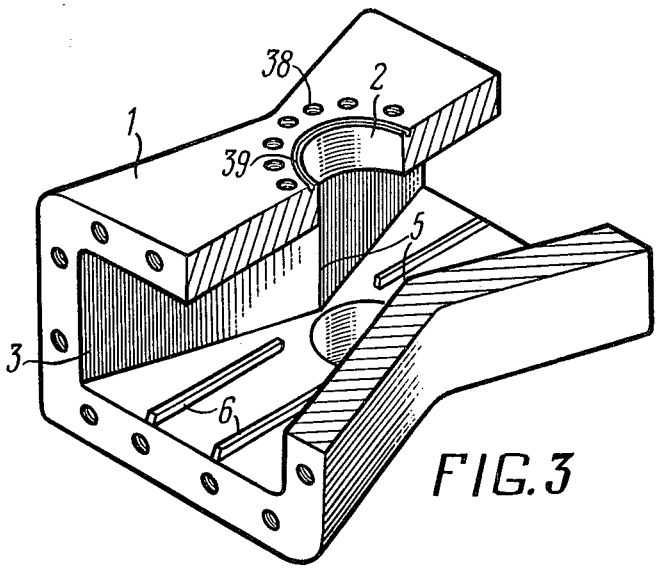
FIG. 3
FIG. 4
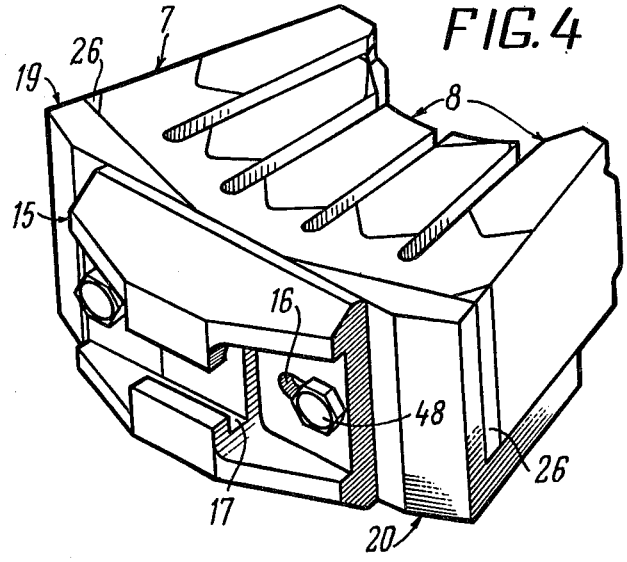

BLOWOUT RAM PREVENTER

The present invention relates to preventers intended for sealing the mouths of oil and gas wells.

The known preventers are divided into the categories of ram and universal preventers.

A ram preventer usually comprises a housing with covers, rams arranged in its plane and hydraulic cylinders secured to the housing covers. The hydraulic cylinders accommodate pistons with rods adapted for moving the rams.

The preventer housing is made in the form of a massive steel casting or forging of a box or oval section with a central through bore for passage of the tool. The inner walls of the housing serve as guides for the rams.

The lower surface of the inner cavity of the housing is provided, as a rule, with longitudinal ribs which form a passage for the fluid (oil, drilling mud) and gas from the well.

The inner cavity of the housing intended to receive the rams is closed at both ends thereof with covers which are attached to the housing by bolts or studs. The covers are adapted for rotation on axles secured at the ends of the housing and have, as a rule, passages for admitting fluid to the hydraulic cylinder.

The surfaces of the covers adjoining the housing are provided with grooves to accommodate sealing elements for sealing the housing-to-cover-joint.

The rams can be rectangular, semi-circular, oval or in the form of flat semi-discs. Constructionally, the rams are integral metal blocks with a sealant inserted therein or composed of a housing and an insert with said sealant inserted therein.

Each ram is linked with the rod of the hydraulic cylinder at a side opposite to the through bore in the housing.

To seal the well head with the tool in the well, use is made of casing rams whose butt ends facing the vertical bore are provided with a cutout whose radius corresponds to the radius of the tool being sealed off (drill pipe).

To seal off a well head without the tool in the well, use is made of rams whose butt ends facing the vertical bore have no cutouts, i.e. are made flat.

As a rule, the ram portion facing the bore has guide projections which are arranged at both sides of the drill pipe cutout. These projections serve to align the string of drill pipes.

The ram preventer operates as follows. To close the preventer, a pressure is applied to the hydraulic cylinder locking cavity through pipe-lines arranged on the housing or through channels made directly in the housing. The pressure makes the piston and rod move towards the through bore. The movement, i.e. the stroke, of the piston and rod, hence the movement of each ram generally corresponds to a half-diameter of the through bore in the housing. The rod moves the ram towards the through bore in the preventer housing. The ram projections displace the pipe to the center of the through bore and the cut-out rams seal about the pipe. The well pressure presses the ram against the upper wall of the housing cavity and, through the passage between the longitudinal ribs of the lower wall of the housing cavity, presses the rams against the drill pipe and against one another, thus sealing off the preventer.

When opening the preventer, the piston moves to the initial position. The piston rod pulls the rams and opens the preventer.

The ram preventers are compact, simple to control and operate but have a number of disadvantages, the main one consisting in that the rams are capable of sealing off only one particular diameter of pipe, thus necessitating the employment of sets of rams or replaceable inserts with packing elements to fit pipes of different diameter as well as of special rams or inserts with packing elements for sealing off a wellhead having no tool in its bore.

Additionally, the ram preventers cannot be used for sealing square- or hexagonal-section drill pipes.

To eliminate these disadvantages, use is made of universal preventers.

The universal preventer housing is made in the form of a thick-wall bush of a large diameter whose lower portion usually terminates in a flange for mounting the universal preventer on the ram preventer and connecting it to the latter.

A cover with a vertical through bore surrounded by a sealing groove is attached to the housing. An annular packing element and a cylindrical plunger are arranged inside the housing. The inner cavity of the cylindrical plunger is made conical, expanding upward. The outer surface of the plunger has a circular projection which accommodates sealing elements and divides the inner cavity of the housing into two chambers communicating with a hydraulic drive.

Installed inside the inner cone cavity of the plunger is an annular cone-shaped packing element which is made of a deformable resilient material reinforced with metal elements. Provided in the center of the packer is a vertical through hole which corresponds to the vertical bore made in the housing cover.

The preventer operates as follows. A pressure fed to the locking chamber inside the housing forces the plunger to move upward along the outer cone surface of the packing element. The packer with reinforcing members is displaced towards the center of the vertical hole to close it.

After closing the vertical bore and sealing off the well, the well pressure acts on the packer thus improving sealing.

The universal preventer seals tools of any diameter and shape and provides for sealing off the well with or without the tool as well as for performing reciprocation with the mouth sealed off.

However, the universal preventer has a number of significant disadvantages. Inasmuch as sealing is effected by a considerable displacement of the elastic packing, this results in premature destruction of the latter.

The reinforcing elements are arranged on the outside diameter of the packer and with the packer shifted through the maximum travel thereof, said members from the inside diameter which cannot be smaller than the maximum diameter of the pipe sealed off from the pipe string by a given preventer. Therefore, when sealing drill pipes, and especially if a mouth without pipes is sealed off, the major area of the resilient packer material is not protected by the reinforcing elements and is therefore exposed to the well pressure which may reach considerable values. This dictates increasing the packer height. A large height of the packer and considerable bulk thereof, which are necessary for closing the through bore, result in such an increase of the overall dimensions of the universal preventer that its height exceeds, by several times, the height of the ram preventers. Furthermore, to replace the annular packer, it is necessary to remove the preventer cover which is difficult when the tool is in the well and requires additional height under the deck of the rig base for accomplishment of this operation.

Development work is constantly carried out at present to provide compact, reliable and universal preventers.

In the art there is known a universal preventer with compound rams which encompass a tubular resilient member during sealing. Such preventers, though universal to some extent, have not found wide application because of the low reliability thereof. The packer of said preventer is made of a deformable resilient material, is not reinforced, hence fails to ensure reliable sealing, especially at high pressures in the well, because of its premature destruction. This preventer does not offer a noticeable advantage in size either.

In the art there is known another ram preventer with a universal ram, comprising a set of small rams made in the form of a plurality of plane-parallel members covered with a resilient material. Each ram is actuated by an individual hydraulic drive. Constructing the ram as a plurality of small ram segments ensures a multi-purpose use of the preventer but rules out centering of the string of drill pipes in the well. The intricate design of a ram from a plurality of small ram segments and especially with the individual hydraulic drives, leads to insufficient reliability and has dictated a restricted use of this preventer.

Another known ram preventer has a ram made of a resilient material in the form of a rectangular block reinforced from the housing vertical bore side by parallel metal members. The disadvantage of such a ram resides in that a plurality of reinforcing members makes the ram too rigid thus requiring the application of considerable forces for sealing off the pipe. Furthermore, such a ram cannot be used for centering of pipes, especially small diameter pipes, and the well head cannot be properly sealed off.

In connection with the above, the afore-disclosed preventer has not found wide application either.

In the art is also known a preventer whose packer moves along a spherical surface during the sealing of the pipe. This preventer offers some advantages over the universal preventer described above but it has large dimensions and is rather complicated to manufacture.

Another known universal preventer has a packer made in the form of a split ring reinforced with members which move during the sealing on one another to approach the center of the vertical bore. The packer is moved by eight radial hydraulic cylinders. Owing to complicated technology and insignificant benefits from smaller overall dimensions, this preventer is used in drilling to a limited degree.

Universal preventers cannot prevent the sealed string from receiving the driving pressure in the well and are used only in combination with ram preventers.

Thus, a modern preventer system comprises a universal and several (2 to 4) ram preventer which results in a high metal usage and high cost. Furthermore, such a preventer system has great height and requires considerable space under the deck of the rig base. A higher base of the drill rig requires more metal for construction, increases the cost and complicates the operation.

An object of the present invention is to provide a preventer which will improve the reliability of the well sealing.

Another object of the present invention is to provide a preventer which will seal off tools of any diameter and shape.

Still another object of the present invention is to provide a simple-design preventer whose overall dimensions will not exceed the overall dimensions of the ram preventers in use.

Yet another object of the present invention is to provide a preventer whose design permits decreasing the height of the preventer unit.

Another object of the present invention is to provide a preventer whose design permits replacement of the packer irrespective of whether the tool is in the well.

Another object of the present invention is to provide a single preventer which is convenient in operation.

The above and other objects of the invention are achieved in a ram preventer comprising a housing with a central through bore for a tool to be sealed off and guides inside said housing on which are reciprocatedly arranged rams made of an elastic packing material with reinforcing members thereof enveloped by the ram body, and according to the invention, the spacing between the guides located in a plane parallel to the plane of the axis of said bore is uniformly reduced in the direction from the housing ends to said bore, the spacing between the ends of said guides in the vicinity of said ends of the housing being equal to or exceeding the diameter of said bore, the packer reinforcing members being arranged radially in the direction of the through bore, while the ram body is comprised of at least two coupled members converging during reciprocation of the ram.

The preventer according to the invention provides for reliable sealing of a tool of any diameter and shape and seals off the well with the tool removed therefrom.

This rules out the necessity for providing the preventer with replaceable rams for sealing pipes of different diameters.

The design of the preventer ensures reciprocation and turning of the pipe under well pressure without disturbing the sealing.

Additionally, there is no need for preventer assemblies with a great number of preventers, hence the height and weight of the preventer set is reduced, thus reducing the height of the drill rig platform.

In case of failure of the packer in the preventer, it may be replaced irrespective of whether the tool is in the well.

The preventer is simple and convenient to operate.

It is preferable that each member of the ram body be L-shaped in cross section.

Due to the L-shaped members, the ram body covers the packer resilient material from the side opposite the reinforcing members and directs and material towards the bore to the tool being sealed.

Moreover, such a shape ensures covering the lower part of the packer thus preventing the forcing out of the resilient material downwards.

The ram body may be made of three members: a central member linked with the drive and two L-shaped side members coupled movably to each other and to said central member. The side members are rigidly secured to the packer. Such a design of the ram body offers free movement of the members relative to each other during displacement of the ram and prevents wedging of the latter in the guides.

Furthermore, such a design of the ram body is simple from the production viewpoint.

It is preferable that each reinforcing member be made in the form of two plates rigidly interconnected and narrowing uniformly towards the through bore, the face of the plate directed towards said bore having a recess ensuring maximum approach of the reinforcing members to the tool being sealed.

Such a design of the reinforcing members provides a ram of a small height but strong enough to withstand high well pressures. The major part of the bore is overlapped by strong reinforcing members and reliably protects the resilient material of the packer.

This ensures the minimum distance between the reinforcing members and the tool which reduces the area of the unprotected part of the resilient material and provides for reciprocation and turning of the pipe with the tool in the well without disturbing the sealing.

According to one embodiment of the invention, the preventer may have guides located in a plane parallel to the plane of the through bore axis, said guides being formed by two inserts made in the form of a rectangular prism having an equilateral triangle as its base, and fabricated of a resilient material reinforced by metal members.

This provides for using a series ram preventer for manufacturing the preventer according to the present invention. To this end, the inserts are arranged in the preventer housing cavity and cone rams are positioned between the inserts. The design of the ram ensures sealing along the housing and the ram without additional sealing members.

Other objects and advantages of the present invention will be more readily apparent from the following detailed description of preferred embodiments thereof with reference to the accompanying drawings, wherein:

FIG. 3 is a perspective view, partly broken away and in section of a preventer housing;

FIGS. 4 and 5 are perspective views of a ram and parts of the body thereof;

Figure 1:
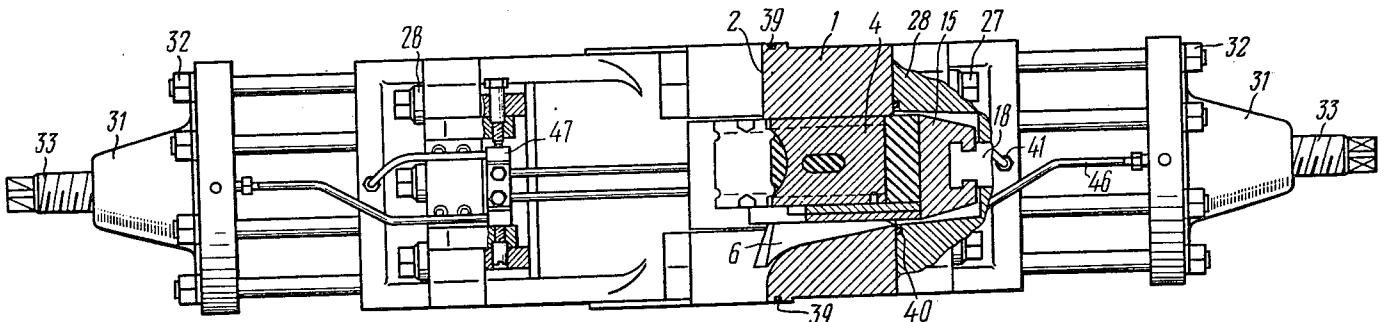
FIG. 1 is a plan view, partly in section, of a preventer, according to the invention.

The preventer according to the present invention comprises: a housing 1 of a box shape with a central bore 2 for the tool being sealed off (not shown). Threaded holes 38 and grooves 39 are provided on the external sides of horizontal walls of housing 1 for joining the preventer with other elements when mounting the latter on the well mouth. The inner walls of the housing 1 serve as guides 3 for rams 4 arranged in the cavity of the housing 1. The transverse spacing between the guides 3 uniformly decreases in the direction from the ends of the housing 1 to the bore 2. The distance between the ends 5 of the guides 3 in the vicinity of the bore 2 is equal or exceeds the diameter of the bore. Several longitudinal ribs 6, wherealong the ram 4 moves, are arranged on the lower surface of the inner cavity of the housing 1. Gaps between the ram 4 and the housing 1 permit using the well pressure for improving the sealing of the working tool.

Figure 2:
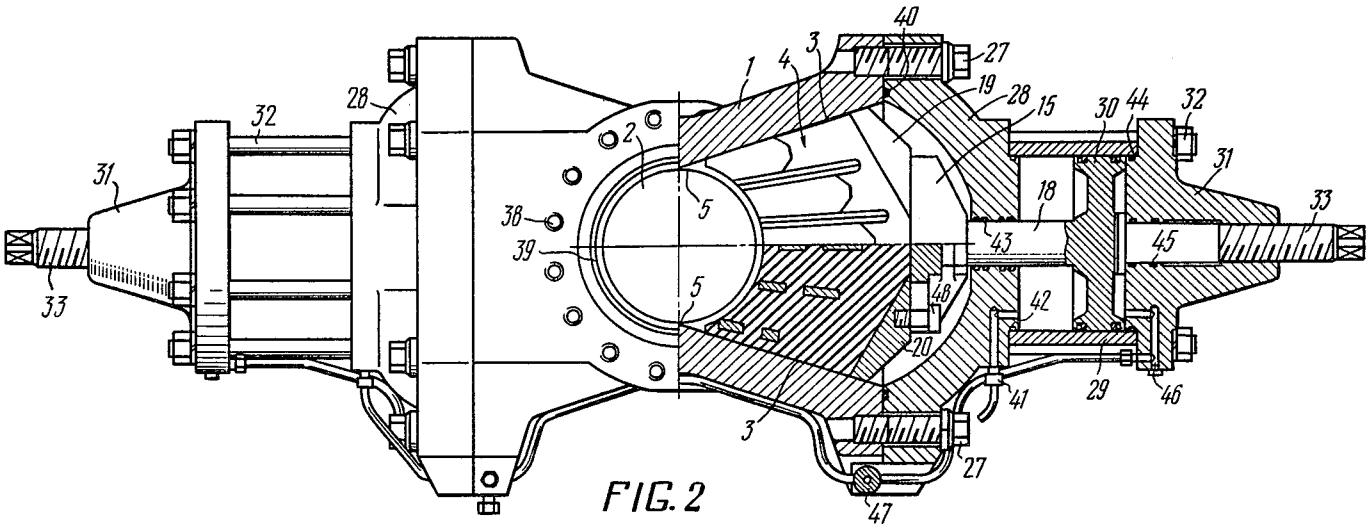
FIG. 2 is a longitudinal part section of the preventer shown in FIG. 1.
Figure 5:
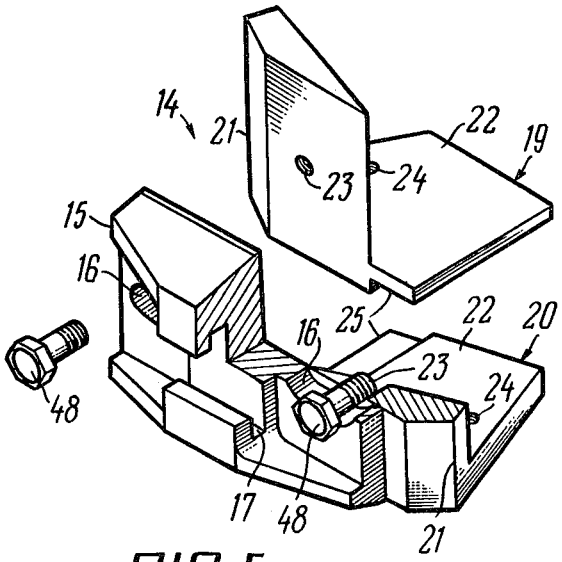
Figure 6:
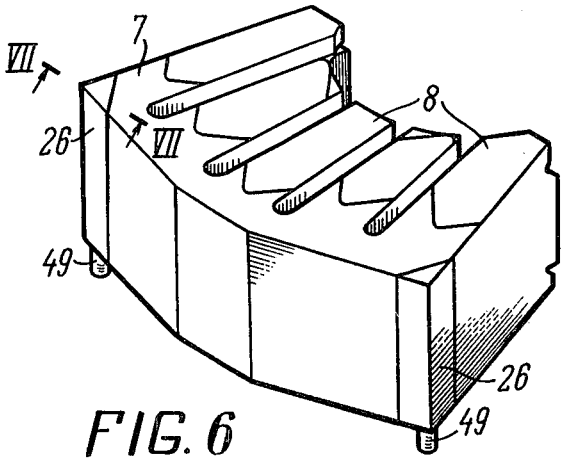
FIG. 6 is a perspective view of packing.
Figure 8:
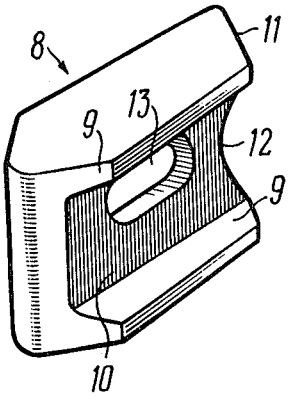
FIG. 8 is a perspective view of a ram packing reinforcing member.
Figure 7:
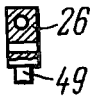
FIG. 7 is a section taken along line VII—VII of FIG. 4.
Figure 9:
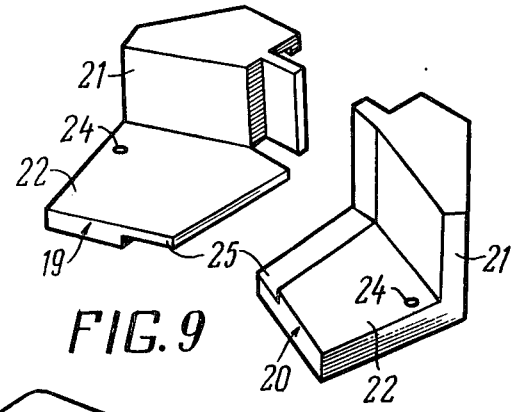
FIG. 9 is a perspective view of an embodiment of ram body.

The rams 4 (FIGS. 4, 5, 6) are made of a resilient packing 7 and are reinforced from the side of bore 2 by radially arranged members 8 formed as horizontal plates 9 which narrow in the direction of the bore 2 and have a vertical connection member 10, the side 11 of the plate 9 facing the bore 2 being bevelled to ensure maximum approach of the reinforcing members 8 to the tool being sealed. A surface 12 of the connection member 10 facing the bore 2 is provided with a radial recess and a hole 13 is provided in the center of the connection member 10 to ensure better adhesion of the reinforcing member 8 with the resilient material of the packer 7. The body 14 of the ram 4 (FIGS. 1, 2, 5) is constituted of three coupled members, namely: central member 15 whose vertical wall has through grooves 16 and T-shaped groove 17 for coupling with rod 18 of a hydraulic cylinder, and L-shaped side members 19, 20. The members 19, 20 of the body 14 have vertical walls 21 with threaded holes 23 for connecting the central member 15 with bolts 48, and horizontal walls 22 with holes 24 to ensure rigid connection to the packer 7. Stepped grooves 25 are provided in the horizontal wall 22 for joining the members 19, 20. The body 14 of the ram 4 may also be comprised of two coupled members 19, 20 (FIG. 9) movable with respect to each other during displacement of the ram 4. The packer 7 is reinforced by a member 26 which ensures rigid connection of the packer 7 with the side members 19, 20 of the body 14.

Connected by bolts 27 to the housing 1 (FIGS. 1, 2) of the preventer are covers 28 which mount hydraulic cylinders 29 with pistons 30 and rods 18. The cover side adjoining the housing 1 is provided with grooves to accommodate sealing element 40 for sealing the cover 28 to the housing 1. The cover 28 has a channel 41 for introduction of pressure fluid for opening the piston 30, and a channel with a sealing element 42 for sealing the hydraulic cylinder. Sealing elements 43 disposed in the cover serve for sealing off the rod 18. Each hydraulic cylinder 29 is closed by a cover 31 coupled to the cover 28 by studs 32. The cover 31 has a screw 33 and the ram 4 can be fixed in the closed position by threading in said screw. The cover 31 has a sealing element 44 for sealing the cover to the hydraulic joint, and sealing element 45, which seal the screw 33. A channel 46 is provided in the cover 31 for introduction of pressure fluid to close the piston 30.

Figure 10:
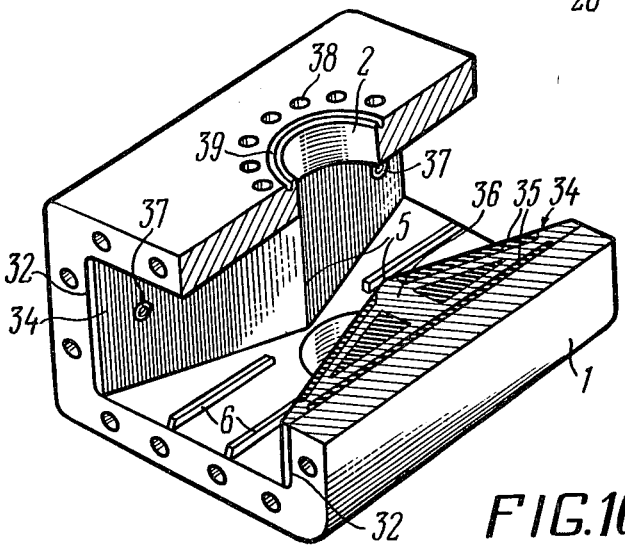
FIG. 10 is a perspective view partly broken away and in section of an embodiment of a preventer housing with detachable inserts.

The guides 3 of the housing 1 of the preventer may be made in the form of two inserts 34 (FIG. 10) of a resilient material 35 (such as rubber) reinforced by metal members 36. Each insert 34 is made in the form of a right triangular prism which has an equilateral triangle as its base. The inserts 34 are arranged symmetrically relative to the bore 2 of the housing 1 and are rigidly secured to opposite walls of the housing 1 by screws 37.

The preventer operates as follows.

Pressure of the fluid fed into the hydraulic cylinder 29 (FIG. 2) moves the piston 30 towards the bore 2. The rod 18 of the piston 30 pushes the central member 15 of the body 14 of the ram 4. The central member 15 of the body 14 of the ram 4 presses against the side members 19, 20, whose vertical walls 21 slide along the central member 15, while the horizontal walls 22 move along the guides 3 and on ribs 6 on the inner cavity of the preventer housing 1.

The ram 4 moves in the narrowing horizontal cavity of the preventer housing 1, and in the process the width of the resilient packer 7 is reduced, while the length thereof increases, thus pushing the reinforcing members 8. The larger the stroke of piston 30, the greater the bore 2 is restricted by the rams 4. The reinforcing members 8 of the packer 7 intersect the vertical bore 2 of the housing 1, the plates 9 of said members converging in the radial direction, thus protecting the resilient packer 7. The reinforcing members 8 tend to move ahead in the packer 7 under the thrust of the piston, but they lag slightly behind a small portion of the resilient packer 7 displaced into the bore 2. Since the ram 4 keeps on moving, said portion of the resilient packer 7 which is somewhat ahead with respect to the reinforcing members 8 comes into contact with a similar portion of the resilient material of the second ram 4, thus fully closing off the vertical bore 2. The major part of the cross-section of the bore 2 is closed by the reinforcing members and only a narrow section of the packer 7 located on the lateral axis of the preventer remains unprotected. Since the length of ram 4 changes in the course of movement thereof, the stroke of the piston 30 adapted to close the preventer is shorter than that of the prior art preventers. If the working tool is in the well, the reinforcing members 8 converge on the tool and embrace the latter irrespective of its shape. The resilient material of the packer 7 pressed by the members 15, 19, 20 of the housing 14 of the ram 4 fills the space between the guides 3 and when abutting the resilient packer 7 of the other ram 4 seals off the well complete with the tool located therein. Thus, the well mouth is sealed off together with the tool by a minimum volume of the forced-out resilient material of the packer 7, the shape of the tool being of no consequence.

The preventer will align the string of drill pipes in the well. Since the reinforcing members 8 are arranged in the packer 7 close to the trough bore circle, these are abutted by the reinforcing members 8 of the second ram 4 successively from the periphery to the center. The side reinforcing members 8 converge first, then, the intermediate ones, and, finally, the central members. Said members 8 abut and constantly press the drill pipes towards the center of the bore 2, thus aligning said pipes.

Since the reinforcing members 8 come up almost to the tool and seal it by a minimum amount of the resilient material forced out of the packer 7, reciprocation may be readily performed with the well mouth being sealed off, resulting in an insignificant wear of the packer material, this being compensated for by a continuous pressure of the ram 4 effected by the piston 30 due to a flow-over of the resilient material of the packer 7 between the reinforcing members 8.

The preventer is opened in the reverse order. The pressure is applied to the hydraulic cylinder 29 to effect the opening. The piston 30 starts moving away from the bore 2 and pulls, via rods 18, the central members 15 of the body 14 of the rams 4 coupled to the side members 19, 20 which, in turn are coupled with the packers 7. The packers 7 release the grip, the members 19, 20 come apart and the rams 4 retreat thus opening the bore 2 of the preventer.

The rams can be replaced as follows. The bolts 27 are unscrewed. The cover 28 is turned around the axis and the packer sealing element 7 (FIG. 4) is removed from the ram 4. The ram housing 14 comprising parts 15, 19, 20 (FIG. 5) remains connected to the rod 18. A new packer 7 is installed on the side elements 19, 20 in such a manner that projections 49 of reinforcing elements 26 enter the holes 24. Then the cover 28 is replaced and clamped to the housing 1 with bolts 27.

What we claim is:

1. A blowout ram preventer, comprising: a housing having opposite ends, said housing being provided with a longitudinal cavity and a transverse central bore; guides in the cavity of said housing, the transverse spacing between said guides decreasing uniformly in a direction from the ends of said housing towards said bore, said guides adjacent said bore being spaced a distance at least equal to the diameter of said bore; a pair of opposed rams slidably mounted in said cavity for undergoing reciprocal movement relative to said bore, each said ram including a packer of resilient material having one end with reinforcing members therein facing said bore, and a ram body engaging said packer at the opposite end thereof, said ram body being slidably engaged with said guides, said guides and said ram body confining said packer so that the material of the packer will flow upon reciprocation of the ram, said ram body including a central drive member and two side members which are L-shaped in cross section and are movably coupled to each other and to said central member for undergoing relative movement upon reciprocation of said ram.

2. A blowout ram preventer as claimed in claim 1 comprising fastener means rigidly connecting the side members of the ram body to the packer.

3. A blowout ram preventer, comprising: a housing having opposite ends, said housing being provided with a longitudinal cavity and a transverse central bore; guides in the cavity of said housing, the transverse spacing between said guides decreasing uniformly in a direction from the ends of said housing towards said bore, said guides adjacent said bore being spaced a distance at least equal to the diameter of said bore; a pair of opposed rams slidably mounted in said cavity for undergoing reciprocal movement relative to said bore, each said ram including a packer of resilient material having one end with reinforcing members therein facing said bore, and a ram body engaging said packer at the opposite end thereof, said ram body comprising at least two coupled members slidably engaged with said guides and adapted to move relative to each other upon reciprocation of said ram, said guides and said coupled member confining said packer so that the material of the packer will flow upon reciprocation of the ram, each said reinforcing member comprising two rigidly interconnected plates uniformly narrowing in the direction of said bore, each plate having a surface facing said bore which is bevelled to ensure maximum approach of the reinforcing member to a tool in the bore.

4. A blowout ram preventer, comprising: a housing having opposite ends, said housing being provided with a longitudinal cavity and a transverse central bore; guides in the cavity of said housing, the transverse spacing between said guides decreasing uniformly in a direction from the ends of said housing towards said bore, said guides adjacent said bore being spaced a distance at least equal to the diameter of said bore; a pair of opposed rams slidably mounted in said cavity for undergoing reciprocal movement relative to said bore, each said ram including a packer of resilient material having one end with reinforcing members therein facing said bore, and a ram body engaging said packer at the opposite end thereof, said ram body comprising at least two coupled members slidably engaged with said guides and adapted to move relative to each other upon reciprocation of said ram, said guides and said coupled members confining said packer so that the material of the packer will flow upon reciprocation of the ram, said guides being constituted by two inserts each having the shape of a right prism with a base of equilateral triangular shape, said insert being made of a resilient material reinforced with metal members.

* * * * *